US006712149B2

(12) United States Patent
Leismer et al.

(10) Patent No.: US 6,712,149 B2
(45) Date of Patent: Mar. 30, 2004

(54) APPARATUS AND METHOD FOR SPACING OUT OF OFFSHORE WELLS

(75) Inventors: Dwayne D. Leismer, Pearland, TX (US); Rodney J. Wetzel, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/044,397

(22) Filed: Jan. 9, 2002

(65) Prior Publication Data

US 2002/0096331 A1 Jul. 25, 2002

Related U.S. Application Data

(60) Provisional application No. 60/262,745, filed on Jan. 19, 2001.

(51) Int. Cl.[7] ..... E21B 23/03

(52) U.S. Cl. ..... 166/382; 166/50; 166/117.6; 166/242.1; 166/348; 166/380

(58) Field of Search ..... 166/347, 348, 166/367, 380–382, 313, 50, 117.6, 242.1

(56) References Cited

U.S. PATENT DOCUMENTS 3,861,463 A 1/1975 Crowe
4,089,377 A * 5/1978 Chateau ..... 166/382
4,187,906 A 2/1980 Kovacs
4,497,371 A * 2/1985 Lindsey, Jr. ..... 166/377
5,450,904 A 9/1995 Galle
6,012,527 A * 1/2000 Nitis et al. ..... 166/313
6,311,776 B1 11/2001 Pringle et al. ..... 166/313

FOREIGN PATENT DOCUMENTS

GB 2 371 317 A 7/2002

* cited by examiner

*Primary Examiner*—David Bagnell
*Assistant Examiner*—Zakiya Walker
(74) *Attorney, Agent, or Firm*—Trop, Pruner & Hu, P.C.; Jeffrey E. Griffin; Brigitte Jeffery Echols

(57) ABSTRACT

An apparatus and technique for use in spacing out tubular strings within a well includes a casing that has an inner wall and at least one profile that is disposed within the inner wall. A tubing hanger is attached to the well tubing and if capable of landing within a target location, such as a wellhead. When the landing tool is seated within the profile, the length of well tubing needed to land the tubing hanger within the target location can be determined. A landing tool is linked to well tubing and is sized so as to seat within the profile.

43 Claims, 6 Drawing Sheets

APPARATUS AND METHOD FOR SPACING OUT OF OFFSHORE WELLS

This application claims the benefit of U.S. Provisional Application No. 60/262,745, filed on Jan. 19, 2001.

BACKGROUND OF THE INVENTION

1. Field of the Invention

This invention relates generally to subsurface tools used in the completion of subterranean wells and, more particularly, provides an apparatus and method for use in spacing out tubular strings and components within a wellbore.

2. Description of Related Art

Hydrocarbon fluids such as oil and natural gas are obtained from a subterranean geologic formation, i.e., a reservoir, by drilling a well that penetrates a hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, the production of oil and gas can begin.

Typically, one of the final steps taken in the completion of a well is the running into the well of the production tubing. Once the production tubing is inserted into the well, the bottom of the tubing string may need to be located at a certain position in relation to other downhole equipment, such as being inserted into a polished bore receptacle of a packer that had been previously set. Just as the bottom of the tubing string needs to be located in a predetermined depth, likewise the top of the tubing string has to be located so as to properly "land" the tubing hanger within the wellhead. In order for both the top and bottom of the tubing string to be in their proper locations, the length of the tubing string is measured and controlled. This operation is called the "spacing out" of the well.

For wells drilled on land, the spacing out of the production tubing is a relatively simple task. The tubing is run into the well to the depth of the packer until contact with the packer is indicated by a decrease in the weight of the tubing string. At a predetermined "slack off" weight, the tubing is marked and measured. The upper joint of tubing is removed and replaced with one or more shorter tubing sections, often called "subs", that will make the overall tubing string the length needed for the proper well space out. Since the wellhead, completion unit and personnel are located at the surface, the spacing out of the tubing string is usually a minor task.

On wells that are drilled offshore that contain a subsea wellhead, the operation of spacing out a well can be difficult. The wellhead where the tubing must be landed is located on the ocean floor, not where the rig and personnel are located. For wells being completed from fixed platforms, the distance from the rig floor to the wellhead can be measured and compensated for. One method is to run the tubing into the well until the required slack off weight is seen. Then rather than just the top joint being removed, the length of tubing from the rig floor to the wellhead on the ocean floor must be pulled to enable the proper space out to be made. After the proper adjustments are made and the tubing hanger is attached, the modified tubing string length will be run back into the well. For example, a well drilled in a water depth of 2,000 feet that needs an adjustment of 10 feet for proper space out, would require the pulling and subsequent re-running of the 2,000 feet of tubing, for a total handling of 4,000 feet of tubing. Alternately, the tubing hanger can be attached to the tubing string on the initial run into the well at a location that is estimated to be correct. If the location is within the variance of the downhole tool, such as the length of the polished bore receptacle, the tubing will not need to be pulled and adjusted. Using specialized tools, such as packers with longer than usual polished bore receptacles and tubing seal assemblies with extra length and multiple seals, will increase the possibility of success with this alternate method, but will also increase the material cost incurred.

Wells being completed from floating drilling rigs such as semisubmersibles or drillships pose additional problems. The "heave" of the floating rig, along with variations in the positioning of the rig over the well, results in the distance from the rig floor to the wellhead not being a fixed length (i.e., being a variable length). This length can vary by as much as three feet or more, depending on tidal and wave conditions, which can make the methods of spacing out mentioned above unworkable, difficult or time consuming to perform. The amount of heave can also vary depending on the age, design and level of sophistication of the rig positioning system. To compensate for the rig heave, additional equipment, such as expansion joints, sliding sleeves, extended seal assembly lengths and multiple seals have been employed.

There is a need for improved tools and methods to enable the proper spacing out of offshore wells.

SUMMARY OF THE INVENTION

One embodiment of the present invention is a system for use in spacing components within a wellbore. The system comprises a well casing comprising at least one profile, the profile capable of being positioned at a known location within the wellbore and adapted to indicate the location of at least one component inserted into the wellbore.

Another embodiment of the present invention comprises an apparatus for use in spacing out tubular strings within a well comprising a casing having an inner wall where the casing includes at least one profile disposed within the inner wall. A landing tool is linked to well tubing and is sized so as to seat within the profile. A tubing hanger is attached to the well tubing, the tubing hanger being capable of landing within a wellhead. When the landing tool is seated within the profile, the length of well tubing needed to land the tubing hanger within the wellhead can be determined. The tubing string can be inserted within the well. The distance between the wellhead and the profile can be known.

The casing can comprise an upper profile and a lower profile and the distance between the upper profile and the lower profile can be known. The landing tool and the upper profile are capable of being in a releasably seated configuration.

Yet another embodiment of the invention can be used for the spacing out of tubular strings within a well that comprises a casing having an inner wall, the casing comprising an upper profile and a lower profile. A well tubing is movable longitudinally within the casing and a landing tool is linked to the well tubing. The landing tool can comprise seating projections that are adapted to sequentially seat in the upper profile and the lower profile. The landing tool and seating projections can be adapted to reversibly seat in the upper profile, allowing movement of the landing tool in either an upward or downward direction. The landing tool, seating projections and lower profile can be adapted such that when the landing tool is seated within the lower profile, the landing tool is restricted from any movement in a downward direction but can be unseated from the lower profile and moved in an upward direction. The landing tool and seating projections can be adapted to release from the upper profile when a predetermined slack off weight is exceeded. When the landing tool is seated within the upper profile, the length of well tubing needed to space out the well tubing can be determined.

Still another embodiment of the invention is a method of spacing components within a wellbore. The method comprises providing a well casing comprising at least one profile and inserting at least one component within the wellbore wherein at least one component can releasably engage with the at least one profile. The effects of the engagement of at least one component with the at least one profile are observed and the amount of component movement required to obtain a desired component placement within the wellbore is determined.

An alternate embodiment of the invention is a method of spacing out a tubular string within a well having a wellhead. This method comprises providing a casing string located within the well, the casing string having an inner wall and at least one profile within the casing inner wall. The casing can include an upper profile, and the profiles can be located at known distances apart from each other and from the wellhead. A tubular string linked to a landing tool is inserted into the well. The landing tool is seated within the upper profile and the correct tubular length required to properly space out the well is determined. The steps in the method can include attaching the landing tool to the tubular string to be spaced out and the landing tool can be capable of seating within the profiles. The method can further include inserting the tubular string to a depth where the landing tool seats within the upper profile, unseating the landing tool from the upper profile, modifying the length of the tubular string, attaching a tubing hanger to the tubular string and inserting the tubular string into the well to a depth where the tubing hanger is disposed within the wellhead.

When the tubing hanger is disposed within the wellhead, the landing tool can be seated within one of the profiles other than the upper profile. The well can further comprise a packer set within the casing string and the tubular string can further comprise a seal assembly capable of being seated within the packer.

Yet another embodiment of the invention is a method of spacing out a tubing string within a wellhead of an offshore well comprising providing a casing string having a first profile, inserting a tubing string within the well having a landing tool that can engage with the first profile, inserting the tubing string until the landing tool engages with the first profile. The length of tubing string needed for proper tubing space out can then be determined, the landing tool disengaged from the first profile, and the tubing string altered to achieve a predetermined length. A tubing hanger is then attached to the tubing string and the tubing string inserted to the depth where the tubing hanger is properly positioned within the wellhead.

The well can further comprise a packer set within the casing string and the tubular string can further comprise a seal assembly and the seal assembly can be capable of being seated within the packer. The disengaging of the landing tool from the first profile can be achieved by imposing a predetermined slack off weight onto the tubing string.

The casing string can comprise a second profile and when the tubing hanger is positioned within the wellhead, the tubing string can be spaced out so that the landing tool is engaged with the second landing profile. The landing tool in conjunction with the second landing profile can be capable of radially orienting the tubing string in relation to the casing string. The tubing string can contain an extension tool that allows the extension of the tubing string below the landing tool. The extension tool can enable the extension of more than one tubing string below the landing tool. The well can comprise at least one lateral wellbore and two tubing strings extend from the extension tool and the two tubing strings each enter separate wellbores.

Still another embodiment of the invention is a method of completing a well comprising providing a well casing comprising at least one profile on its inner wall and inserting the well casing within a wellbore comprising at least one lateral wellbore. At least one component is inserted within the wellbore on a tubular string, the at least one component comprising at least one landing tool that can releasably engage with the at least one profile. The effects of the engagement of at least one landing tool with the at least one profile are observed and the amount of tubular string movement required to obtain a desired component placement within the wellbore is determined.

Another embodiment is a method of completing a well comprising providing a well casing comprising at least one profile on its inner wall and inserting the well casing into a wellbore, the wellbore comprising at least one lateral wellbore. At least one landing tool that can releasably engage with the at least one profile is inserted into the wellbore on a tubular string, the at least one landing tool comprising at least one lower tubing string capable of extending from the at least one landing tool. The effects of the engagement of at least one landing tool with the at least one profile are observed and the amount of tubular string movement required to obtain a desired component placement within the wellbore is determined, the desired component placement comprising the landing of a tubing hanger within a wellhead. At least one lower tubing string is extended from the extension member into at least one lateral wellbore.

DESCRIPTION OF ILLUSTRATIVE EMBODIMENTS

Figure 1:
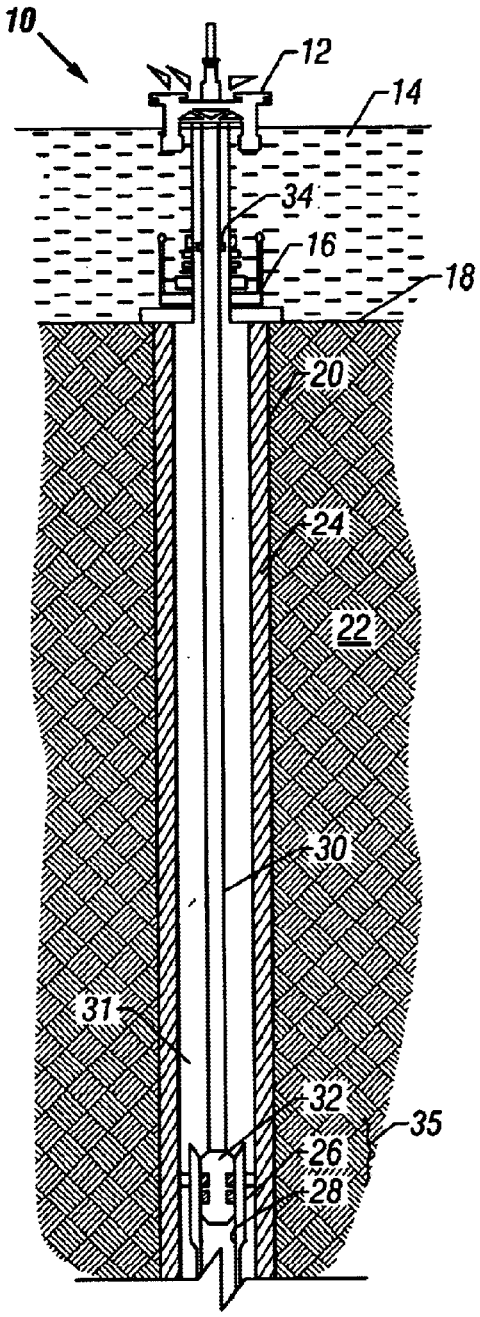
FIG. 1 (Prior Art)
FIG. 1 is a schematic of a typical offshore well.

Referring to FIG. 1, an offshore well, shown generally as 10 is drilled and completed by an offshore drilling rig 12 that is located at the water surface 14. The wellhead 16 is located at or near the ocean bottom (i.e., ocean floor) 18. A wellbore 20 is drilled into a subterranean zone 22 and a casing string 24 is inserted and cemented in place to stabilize the wellbore 20. A tubing string 30, comprising a tubing hanger 34, is run from the rig 12, through the wellhead 16 and down the well 10. The tubing hanger 34 is located at the wellhead 16 and may enable the sealing between the wellhead 16 and the tubing string 30.

The tubing string 30 includes a deployed element 31 that is lowered to a target location 35 on the casing string 24. The deployed element 31 shown in the Figures is a seal assembly 32, and the target location 35 shown in the Figures is the receptacle 28 of a packer 26 that is set within the casing string 24. The seal assembly 32 is adapted to mate with the receptacle 28 and provides a seal between the tubing string 30 and the receptacle 28/packer 26.

Unless otherwise described herein, a deployed element 31 for purposes of this application is an element lowered down a well that must be located at a particular spot in the well (the target location 35) when the tubing hanger 34 reaches the wellhead 16 (where space out is critical). In addition to the seal assembly 32 shown in the Figures, the deployed element 31 may also comprise a packer, perforating gun, a specific section of the tubing string, or one of the elements of a female/male mating mechanism. In addition to the receptacle 28 shown in the Figures, the target location 35 may also comprise a specific section of the casing string 24 or one of the elements of a female/male mating mechanism.

Figure 2:
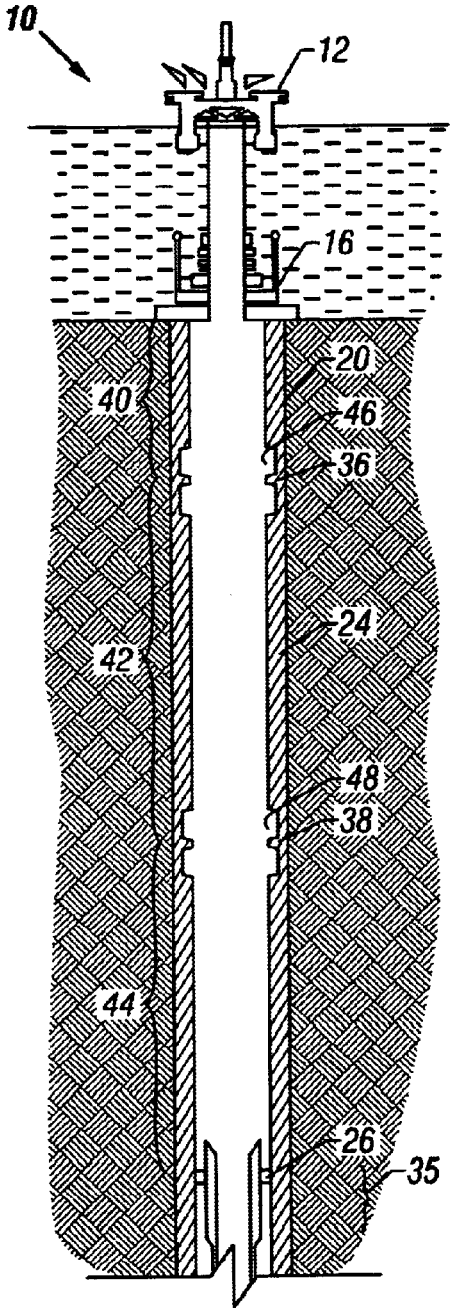
FIG. 2 shows an embodiment of the present invention.

FIG. 2 shows an embodiment of the invention in which a well 10 having a casing string 24 comprises an upper profile 36 and a lower profile 38. The distance between the wellhead 16 and the upper profile 36 is a known length 40. The distance between the upper profile 36 and the lower profile 38 is a known length 42. The packer 26 (target location 35) is at a known distance 44 below the lower profile 38. The upper profile 36, as shown, has angled recesses 46, while the lower profile 38, as shown, has one or more straight recesses 48. Other types, styles and shapes of recesses can be used for the various profiles.

Figure 3:
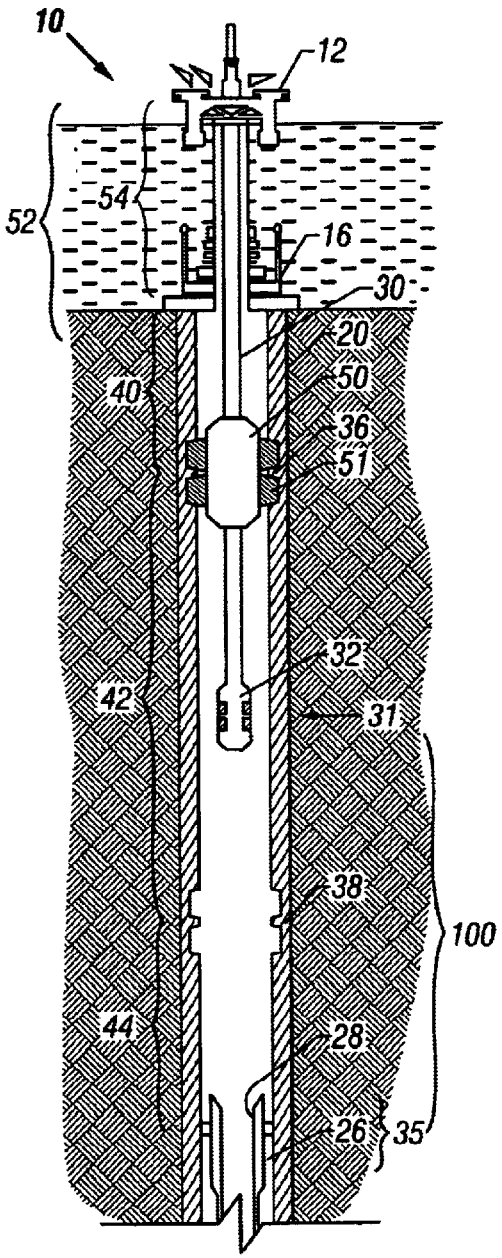
FIG. 3 shows an offshore well schematic in which the tubing string comprises an embodiment of the current invention.

FIG. 3 shows the well as described above and shown in FIG. 2, but including a tubing string 30 that comprises a landing tool 50 that can seat in both the upper profile 36 and the lower profile 38. The tubing string 30 also comprises a seal assembly 32 (deployed element 31) that is located at a known distance below the landing tool 50. In this example the seal assembly 32 (deployed element 31) is located at a distance below the landing tool 50 that is the same as the distance 44 between the packer 26 (target location 35) and the lower profile 38. In this example, when the landing tool 50 is landed within the lower profile 38, the seal assembly 32 (deployed element 31) will be mated with the receptacle 28 of the packer 26 (target location 35).

In another embodiment (see FIGS. 8 and 9, for instance), the deployed element 31 (seal assembly 32) and the tubing can be designed to enable the extension of the tubing and deployed element 31 (seal assembly 32) from the landing tool 50 or from another tool attached to the tubing. Thus, the tubing and deployed element 31 (seal assembly 32) can be further extended into the wellbore after the landing tool 50 has been landed in the lower profile 38 in order to extend the deployed element 31 to the target casing 35. This embodiment will be discussed in greater detail later in the specification.

The landing tool 50 can comprise a number of various embodiments. Examples of alternate embodiments include a packer type arrangement with elastomeric protrusions that expand into the casing profiles; a bow spring device, such as a centralizer, that will also expand into the casing profiles; and a mechanical device having latching "dogs" or spring loaded keys that expand into the profiles, but are able to be disengaged when needed. These are just a few examples of the many different landing tool 50 embodiments that could be used in conjunction with casing profiles. In the embodiment shown in the Figures, the landing tool 50 includes at least one spring loaded dog 51. The dog 51 and upper profile 36 can be configured to releasably mate with each other. The dog 51 and lower profile 38 can be configured to securely mate with each other. The dog 51 and lower profile 38 can also be configured to enable the release of the dog 51 in one direction, such as with an upward movement, while restricting release in another direction, such as with a downward movement.

The primary service of the landing profiles can be to assist in the proper placement of the tubing hanger 34 within the wellhead 16. As the tubing string 30 is inserted into the wellbore 20 the landing tool 50 will initially seat within the upper profile 36. The seating of the landing tool 50 within the upper profile 36 will be seen at the rig 12 as a reduction in the tubing string weight, referred as a "slack off" of the string weight. Once the landing tool 50 is seated in the upper profile 36, the tubing length adjustment needed to land the tubing hanger 34 within the wellhead 16 and the deployed element 31 at the target location 35 can be determined (providing proper space out). By keeping a tally of the lengths of the tubing joints being run into the well, the distance 52 between the rig 12 and the upper profile 36 can be determined. Since the distance 40 from the wellhead 16 to the upper profile 36 is known, the distance 54 from the rig 12 to the wellhead 16, essentially the water depth, can be calculated (distance 54 equals distance 52 minus distance 40). Distance 54 may also be calculated by other methods.

In order to properly space the tubing hanger 34 (shown in FIG. 4) within the wellhead 16, the length of additional tubing to be run or the length of tubing to be removed prior to adding the tubing hanger 34 to the tubing string 30 needs to be determined. The length of tubing adjustment needed prior to attaching the tubing hanger 34 to the tubing string 30 is the difference between the distance 42 between the two profiles 36, 38 and the distance 54 from the rig 12 to the wellhead 16 (length adjustment equals distance 42 minus distance 54). It is noted that in the embodiment in which the deployed element 31 is fixed to (does not extend from) the landing tool 50, the distance 42 is equal to the distance 100 from the deployed element 31 to the target location 35 (when the landing tool 50 is seated in the upper profile 36).

If the distance 42 is greater than the distance 54, the difference between them will be the amount of additional tubing that will need to be added prior to attaching the tubing hanger 34. If the distance 42 equals distance 54, no adjustment in the tubing length is needed prior to attachment of the tubing hanger 34. If the distance 42 is less than distance 54, the difference between them is the length of tubing needing to be removed prior to the attachment of the tubing hanger 34. Once the tubing hanger 34 is attached, the tubing string 30 can be further inserted into the wellbore 20 up to an additional length equal to the distance 54 from the rig 12 to the wellhead 16. The tubing hanger 34 can then be landed within the wellhead 16, resulting in the desired spacing out of the tubing string 30 and any attachments to it.

It is preferable not to remove tubing from the well in order to properly space out the tubing hanger 34, as is the case when the distance 42 is less than the distance 54. Nevertheless, even in these circumstances, the use of the present invention is beneficial. Prior to the landing tool 50 seating in the upper profile 36, an operator may install the tubing hanger 34 on the tubing string 30 at the location he/she estimates to provide the proper space out. Subsequently, as the tubing string 30 is continued to be deployed, the landing tool 50 will land on the upper profile 36. The landing of the landing tool 50 on the upper profile 36 (and the subsequent "slack off" of the string weight) will provide a beneficial check to determine whether the estimated tubing hanger 34 placement is within the tolerances for the particular completion. This check advantageously occurs prior to the complete deployment of the completion.

This invention can also be used and the same calculations and results can be obtained without having a lower profile 38, if that is desired, as long as the distance 100 between the packer 26 (target location 35) and the deployed element 31 (when the landing tool 50 is seated in the upper profile 36) is known. The distance 100 can be calculated by a variety of methods, including by subtracting the distance between the landing tool 50 and the deployed element 31 from the distance between the target location 35 and the upper profile 36. The upper profile 36 would then provide a reference point from which the location of the tubing hanger 34 can be determined in order to land the tubing hanger 34 on the wellhead 16 and the deployed element 31 at the target location 35 (proper space out). In this case, when the landing tool 50 is seated in the upper profile 36, the length of tubing adjustment needed prior to attaching the tubing hanger 34 is the difference between the distance 100 and the distance 54. This equation is adequate however, only if the deployed element 31 is fixed to (does not extend from) the landing tool 50.

In those embodiments including a lower profile 38, the lower profile 38 can assist in holding the tubing string 30 in place, can be designed to radially orient the tubing or a well tool, and/or can be designed to additionally act as a safety stop, preventing the tubing string 30 from going further into the wellbore than is desired. The lower profile 38 can be very useful when used to radially orient a well tool. In this manner, for example, the lower profile 38 can orient tubing and attachments (including the deployed element 31) in both single wellbores and multilateral wells. Orientation by the lower profile 38 can be achieved by inclusion of a muleshoe or other orienting device in or proximate the lower profile 38.

Figure 5:
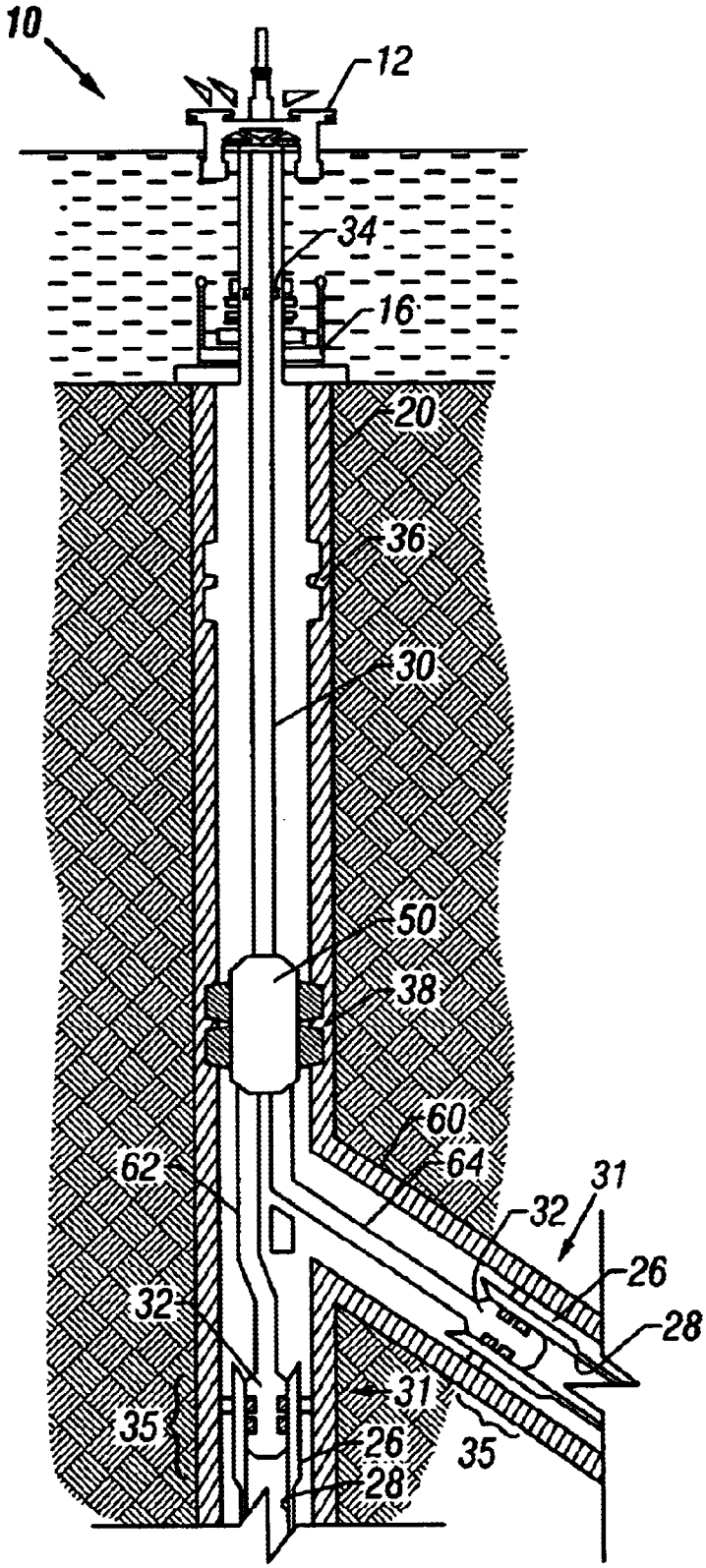
FIG. 5 shows an offshore well schematic which contains a lateral wellbore in which the tubing has been spaced out utilizing an embodiment of the present invention.
Figure 6:
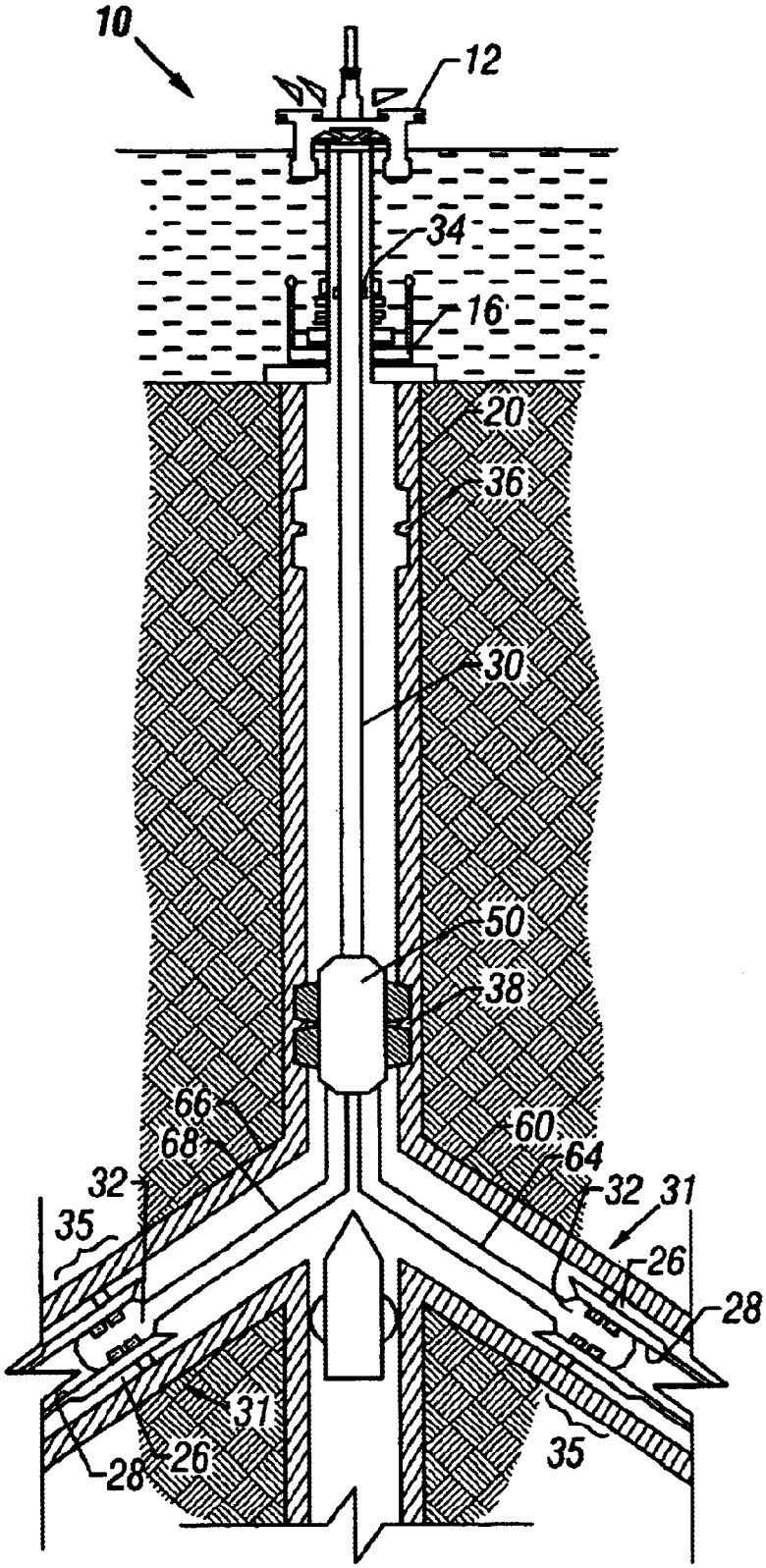
FIG. 6 shows a multilateral offshore well schematic in which the tubing has been spaced out utilizing an embodiment of the present invention.
Figure 7:
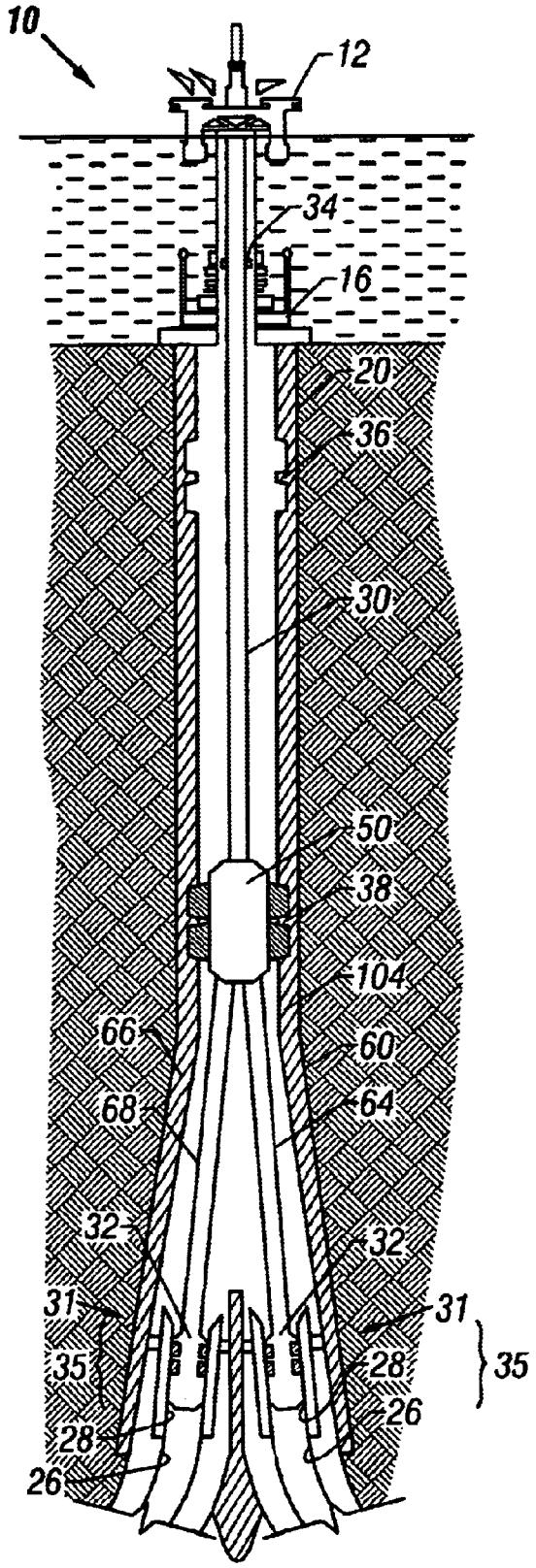
FIG. 7 shows another multilateral offshore well schematic in which the tubing has been spaced out utilizing an embodiment of the present invention.

As shown in FIGS. 5–7, this invention may be used in multilateral wells having a main wellbore 20 and one or more lateral wellbores 60, 66. In these embodiments, multiple tubing strings 64 and 68 can protrude from the landing tool 50, each including a deployed element 31 to be located at a target location 35 within the relevant lateral wellbore 60, 66. This invention can be used in multilateral wells that include either just the upper profile 36 or both the upper and lower profiles 36, 38.

The same type of methodology as described above can be used to properly locate the landing tool 50 within the lower profile 38 when the tubing hanger 34 is landed within the wellhead 16 (providing proper space out). As mentioned above, the lower profile 38 can act in conjunction with the landing tool 50 to locate and/or orient the tubing string 30 and any attachments to it. It is noted that if the aim is to simply land the landing tool 50 on the lower profile 38, then the landing tool 50 acts as the deployed element 31 and the lower profile 38 acts as the target location 35.

Figure 8:
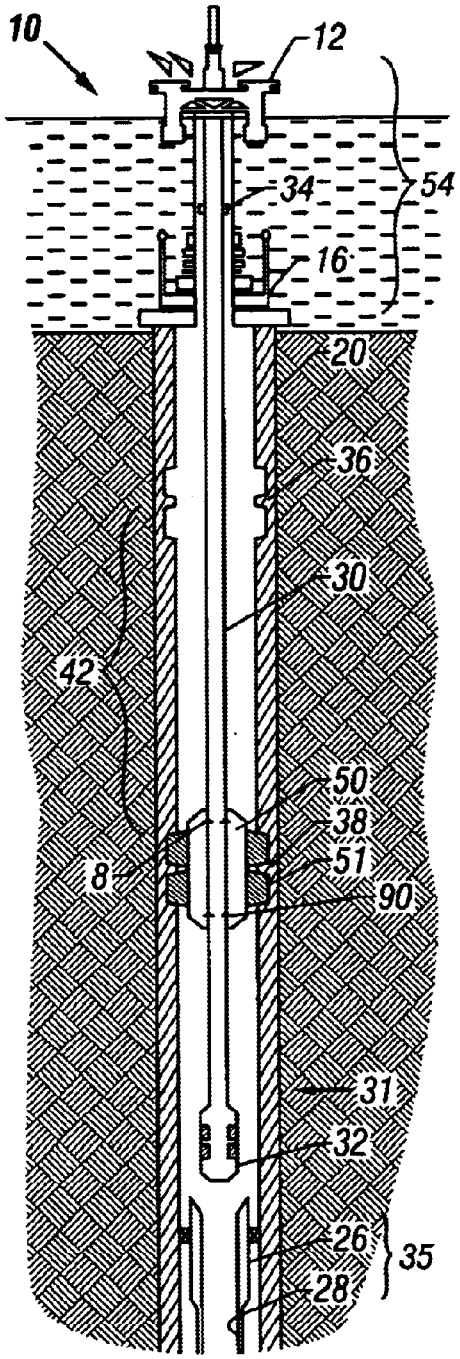
FIG. 8 shows an offshore well schematic including an embodiment of the present invention in which the landing tool is seated in the lower profile, but the deployed element has not yet been extended to the target location.
Figure 9:
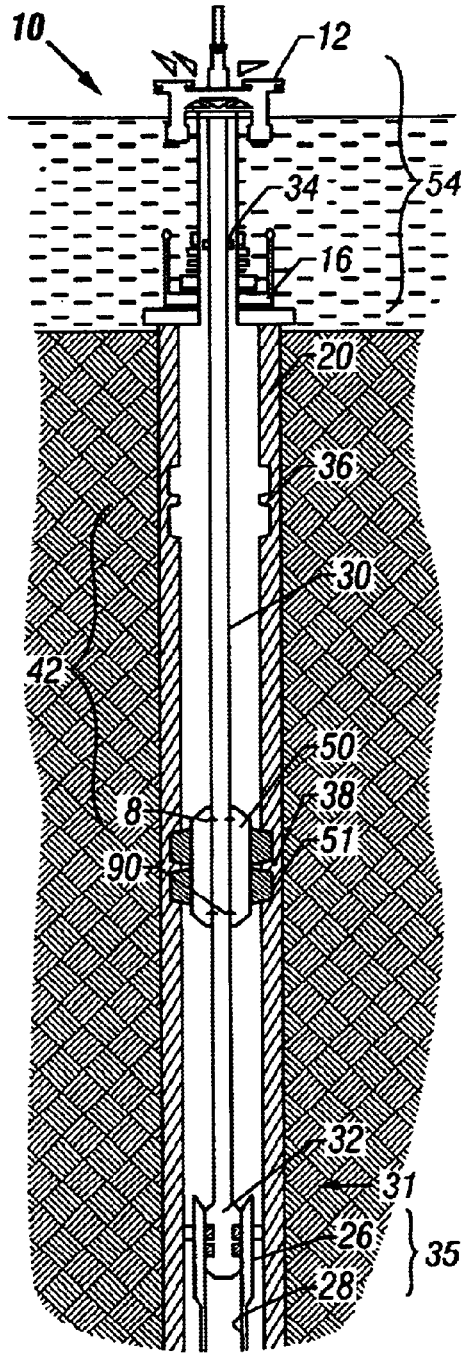
FIG. 9 shows an offshore well schematic including an embodiment of the present invention in which the landing tool is seated in the lower profile, and the deployed element has already been extended to the target location.

In one embodiment of the invention, which is schematically shown in FIGS. 8–9, the deployed element 31 and the tubing string 30 are adapted to be extended once the landing tool 50 is seated in the lower profile 38, thereby bringing the deployed element 31 to the target location 35 and the tubing hanger 34 on the wellhead 16. In this embodiment, the landing tool 50 is seated in the lower profile 38 before the tubing hanger 34 is landed on the wellhead 16. Premature extension of the tubing string 30 is prevented by, for instance, shear pins/rings 90 or locking dogs, which initially connect the tubing string 30 to the landing tool 50. Note that the shear pins/rings 90 should be rated higher than the force necessary to pass the landing tool 50 through the upper profile 36. Once the landing tool 50 is seated on the lower profile 38, force is applied at the surface to the tubing string 30. Since the lower profile 38 is constructed to securely mate with the landing tool 50, such additional force will not move the landing tool 50 from the lower profile 38. However, the additional force on the tubing (if high enough) will enable the extension of the tubing string 30 by releasing the tubing string 30 from the landing tool 50 (by, for example, shearing the shear pins/rings 90 or uncovering the locking dogs). Once released, the tubing string 30 extends downwardly until the deployed element 31 is at the target location 35 and the tubing hanger 34 is at the wellhead 16. For this embodiment, the relevant calculations previously discussed would need to take into account the extension distance of the tubing string 30. Thus, in this case, when the landing tool 50 is seated in the upper profile 36, the length of tubing adjustment needed prior to attaching the tubing hanger 34 is the difference between the distance 42 and the distance 54, plus the extension distance of the tubing string 30. Another way to express the same equation is the difference between the distance 100 and the distance 54, (as illustrated in FIG. 3).

Examples of landing tools 50 that can provide the additional extension of this embodiment are described in U.S. Pat. No. 6,311,776 entitled "Dual Diverter and Orientation Device for Multilateral Completions and Method" by Pringle, Milligan, and Coon which issued on Nov. 6, 2001 and is incorporated herein by reference. This patent describes landing tools that are used with multilateral wells so that multiple tubing strings are extended from the landing tool. It is understood that the same extension mechanism described in such applications can also be used in single bore wells to extend a single tubing string.

It is noted that the extension embodiment can also be incorporated into systems that include only an upper profile 36 and not a lower profile 38. In this case, the length of tubing adjustment needed prior to attaching the tubing hanger 34 is the difference between the distance 100 and the distance 54.

In another embodiment (not shown), the tubing hanger 34 first lands on the wellhead 16. Subsequently, the lower tubing string underneath the landing tool 50 is extended until the deployed element 31 is at the target location 35. Such extension of the lower tubing string underneath the landing tool 50 can be achieved by, for example, a hydraulic mechanism located downhole or further mechanical manipulation from the surface. In this case, the length of tubing adjustment needed prior to attaching the tubing hanger 34 is the difference between the distance 100 and the distance 54, minus the extension distance of the lower tubing string.

This method of landing a tool and then extending a tubing string from the tool can also be used to extend multiple tubing branches. One possibility is with a dual tubing string where one extended tubing string connects with a packer within the main wellbore and a separate tubing string connects with a lateral wellbore coming off from the main wellbore. Another possibility is where a dual tubing string is extended and each tubing string extends into a separate lateral borehole. The landing tools described in the above referenced U.S. Pat. No. 6,311,776 enables the extension of multiple tubing strings.

As shown in FIG. 2, the upper profile 36 can be constructed with a particular configuration of recesses, such as an angled recess 46 that enables the landing tool 50 to seat and remain within the upper profile 36 so that the tubing weight slack off can be seen at the rig 12. But the upper profile 36 is also designed to allow the landing tool 50 to unseat from the upper profile 36 when the tubing weight slack off exceeds a certain amount. For example, the landing tool 50, when seated within the upper profile 36, may be designed to withstand a slack off weight of 10,000 pounds and remain seated, but to release and travel further down the wellbore 20 once the slack off weight exceeds 20,000 pounds.

The lower profile 38 can be constructed with a different particular configuration than the upper profile 36, such as with at least one straight recess 48 that enables the landing tool 50 to seat within the lower profile 38, but will not allow the landing tool 50 to pass through the lower profile 38, as it could with the upper profile 36. The lower profile 38 can therefore act as a stop and can be made to not allow the tubing string 30 and/or any attachments to proceed further down the wellbore 16 than they were designed for, thereby avoiding potential damage. The lower profile 38 can be designed to enable the landing tool 50 to be released (such as by shearing or mechanical unlocking) from the lower profile 38 and be moved in an upward direction, to permit the removal of the tubing string 30 from the wellbore 20.

Figure 4:
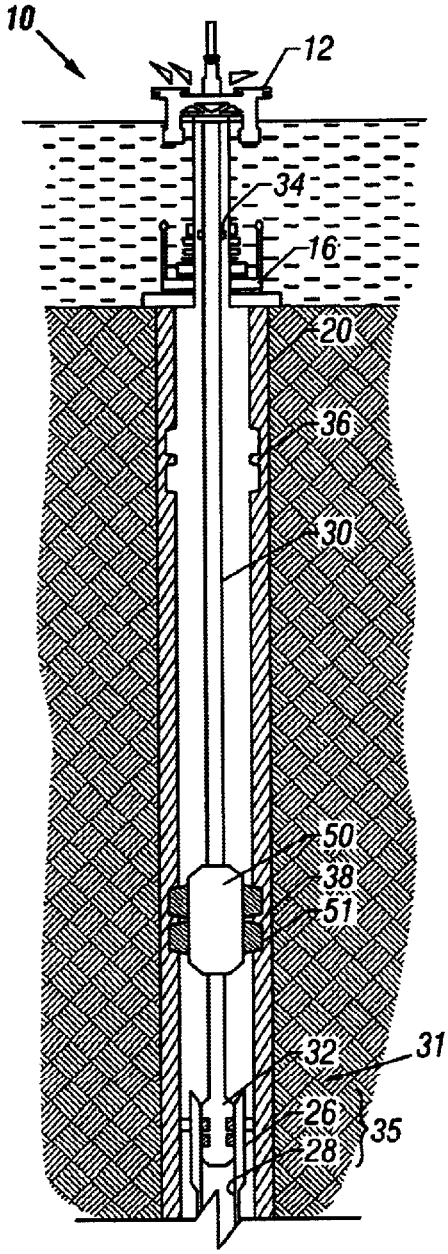
FIG. 4 shows an offshore well schematic in which the tubing has been properly spaced out utilizing an embodiment of the present invention.

FIG. 4 shows an embodiment of the invention having the seal assembly 32 seated within the receptacle 28 of the packer 26, the landing tool 50 seated within the lower profile 38, and the tubing hanger 34 landed at the proper location within the wellhead 16.

FIG. 5 shows a well having a lateral wellbore 60 extending from the main wellbore 20. This illustrates the possibility of using an embodiment of the present invention to properly land the tubing hanger 34 within the wellhead 16, orient and land the landing tool 50 within the lower profile 38, and then if required (optional) extend one tubing string 62 into the main wellbore 20 and extend a second tubing string 64 into a lateral wellbore 60.

FIG. 6 shows a well having two lateral wellbores 60, 66 extending from the main wellbore 20. This illustrates the possibility of using an embodiment of the present invention to properly land the tubing hanger 34 within the wellhead 16, orient and land the landing tool 50 within the lower profile 38, and then if required (optional) extend multiple tubing strings 64, 68 into separate lateral wellbores 60, 66.

FIG. 7 is similar to the FIG. 6, except that FIG. 7 shows the use of the present invention with an integral Level 6 multilateral junction 104 described, for example, in U.S. Pat. No. 5,944,107, incorporated herein by reference.

The discussion and illustrations within this application may refer to a vertical main wellbore that has casing cemented in place. The present invention can also be utilized to complete wells that are not cased entirely and likewise to main wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction, operation, materials of construction or design herein shown, other than as described in the claims below. It is therefore evident that the particular embodiments disclosed above may be altered or modified and all such variations are considered within the scope and spirit of the invention. Accordingly, the invention is therefore to be limited only by the scope of the following claims.

What is claimed is:

1. A system for use in spacing components within a wellbore, comprising:

a well casing comprising at least one profile, the profile capable of being positioned at a known location within the wellbore and adapted to indicate a location of at least one component inserted into the wellbore so that an adjustment to the length of a tubular string attached to said at least one component can be determined to enable landing of a tubing hanger.

2. The system of claim 1, wherein the at least one profile comprises an upper and lower profile.

3. The system of claim 1, wherein the at least one profile is adapted to engage with a landing tool as the landing tool passes through the wellbore.

4. The system of claim 1, further comprising a landing tool capable of engaging with the at least one profile.

5. The system of claim 4, wherein the at least one profile is adapted to radially orient the landing tool within the wellbore.

6. The system of claim 4, wherein the landing tool is capable of extending at least one tubular string into the wellbore after the landing tool has engaged with the at least one profile.

7. The system of claim 6, wherein the wellbore comprises at least one lateral wellbore and the landing tool is capable of extending at least one tubular string into at least one lateral wellbore.

8. The system of claim 4, further comprising:

a wellhead, wherein the tubing hanger is adapted to land in the wellhead.

9. An apparatus for use in spacing out tubular strings within a well comprising:

a casing having an inner wall, the casing comprising at least one profile disposed within the inner wall;

a landing tool that is linked to well tubing and is sized so as to seat within the at least one profile;

a tubing hanger attached to the well tubing, the tubing hanger capable of landing within a target location; and wherein when the landing tool is seated within the at least one profile, the length of well tubing needed to land the tubing hanger within the target location can be determined.

10. The apparatus of claim 9, wherein the well tubing is inserted within the well.

11. The apparatus of claim 10, wherein the target location is a wellhead attached to the casing and the distance between the wellhead and the at least one profile is known.

12. The apparatus of claim 11, wherein the at least one profile comprises an upper profile and a lower profile and the distance between the upper profile and the lower profile is known.

13. The apparatus of claim 12, wherein the landing tool and the upper profile are capable of being in a releasably seated configuration.

14. An apparatus for use in spacing out tubular strings within a well comprising:

a casing having an inner wall, the casing comprising an upper profile and a lower profile;

well tubing that is movable longitudinally within the casing; and a landing tool that is linked to the well tubing and that comprises seating projections adapted to sequentially seat in the upper profile and the lower profile.

15. The apparatus of claim 14, wherein the landing tool and seating projections are adapted to reversibly seat in the upper profile, allowing movement of the landing tool in either an upward or downward direction.

16. The apparatus of claim 15, wherein the landing tool, seating projections and lower profile are adapted such that when the landing tool is seated within the lower profile, the landing tool is restricted from any movement in a downward direction but can be unseated from the lower profile and moved in an upward direction.

17. The apparatus of claim 16, wherein the landing tool and seating projections are adapted to release from the upper profile when a predetermined slack off weight is exceeded.

18. The apparatus of claim 17, wherein when the landing tool is seated within the upper profile, the length of well tubing needed to space out the well tubing can be determined.

19. A method of spacing components within usable with a wellbore, comprising:

providing a well casing comprising at least one profile;

inserting at least one component within the wellbore, wherein at least one component can releasably engage with the at least one profile;

observing the effects of the engagement of at least one component with the at least one profile; and in response to the observation, determining a length of tubing required to obtain desired placement of well equipment attached to the tubing within the wellbore.

20. The method of claim 19, wherein the at least one profile comprises an upper and a lower profile and when the at least one component engages with the upper profile, the amount of movement required to place the at least one component within the lower profile can be determined.

21. The method of claim 19, wherein said at least one component comprises a tubular string that extends into the wellbore.

22. The method of claim 19, further comprising:

moving said at least one component within the wellbore.

23. The method of claim 19, further comprising:

extending a tubular string within the wellbore after the well equipment is at the desired placement within the wellbore.

24. The method of claim 19, further comprising:

extending at least one deployed element into at least one lateral wellbore after the well equipment is at the desired placement within the wellbore.

25. A method of spacing out a tubular string within a well having a wellhead comprising:

providing a casing string located within the well, the casing string having an inner wall and at least one profile within the casing inner wall, the at least one profile including an upper profile, and the at least one profile being located at known distances apart from each other and from the wellhead;

inserting a tubular string linked to a landing tool into the well;

seating the landing tool within the upper profile; and in response to the seating, determining the correct tubular length required to properly space out the well.

26. The method of claim 25, further comprising:

attaching the landing tool to the tubular string to be spaced out; and wherein the landing tool is capable of seating within the at least one profiles.

27. The method of claim 26, further comprising:

inserting the tubular string to a depth where the landing tool seats within the upper profile;

unseating the landing tool from the upper profile;

modifying the length of the tubular string;

attaching a tubing hanger to the tubular string; and inserting the tubular string into the well to a depth where the tubing hanger is disposed within the wellhead.

28. The method of claim 27, wherein when the tubing hanger is disposed within the wellhead the landing tool is seated within one of the at least one profile other than the upper profile.

29. The method of claim 27, wherein the well further comprises a packer set within the casing string, the tubular string further comprises a seal assembly, and the seal assembly is capable of being seated within the packer.

30. A method of spacing out a tubing string within a wellhead of an offshore well comprising:

providing a casing string having a first profile;

inserting a tubing string within the well having a landing tool that can engage with the first profile;

inserting the tubing string until the landing tool engages with the first profile;

determining the length of tubing string needed for proper tubing space out;

disengaging the landing tool from the first profile;

altering the tubing string to achieve a predetermined length;

attaching a tubing hanger to the tubing string; and inserting the tubing string to the depth where the tubing hanger is properly positioned within the wellhead.

31. The method of claim 30, wherein the well further comprises a packer set within the casing string, the tubular string further comprises a seal assembly, and the seal assembly is capable of being seated within the packer.

32. The method of claim 30, wherein the disengaging of the landing tool from the first profile is achieved by imposing a predetermined slack off weight onto the tubing string.

33. The method of claim 30, wherein the casing string comprises a second profile, and when the tubing hanger is positioned within the wellhead the tubing string is spaced out so that the landing tool is engaged with the second landing profile.

34. The method of claim 33, wherein the landing tool in conjunction with the second landing profile are capable of radially orienting the tubing string in relation to the casing string.

35. The method of claim 34, wherein the tubing string contains an extension tool that allows the extension of the tubing string below the landing tool.

36. The method of claim 35, wherein the extension tool enables the extension of more than one tubing string below the landing tool.

37. The method of claim 36, wherein the well comprises at least one lateral wellbore and two tubing strings extend from the extension tool and the two tubing strings each enter separate wellbores.

38. A method of completing a well, comprising:

providing a well casing comprising at least one profile on its inner wall;

inserting the well casing within a wellbore comprising at least one lateral wellbore;

inserting at least one component within the wellbore on a tubular string, the at least one component comprising at least one landing tool that can releasably engage with the at least one profile;

observing the effects of the engagement of at least one landing tool with the at least one profile; and in response to the observation, determining the amount of tubular string movement required to obtain a desired component placement within the wellbore.

39. The method of claim 38, wherein the well comprises a wellhead, the at least one component comprises a tubing hanger capable of seating within the wellhead, and the desired component placement within the wellbore comprises the seating of the tubing hanger within the wellhead.

40. The method of claim 39, wherein the at least one component comprises a landing tool capable of extending at least one lower tubular string into the wellbore.

41. The method of claim 40, further comprising:

extending at least one lower tubular string into the wellbore upon obtaining proper component placement within the wellbore.

42. The method of claim 41, wherein at least one lower tubular string is extended into at least one lateral wellbore.

43. A method of completing a well, comprising:

providing a well casing comprising at least one profile on its inner wall;

inserting the well casing into a wellbore, the wellbore comprising at least one lateral wellbore;

inserting at least one landing tool that can releasably engage with the at least one profile into the wellbore on a tubular string, the at least one landing tool comprising at least one lower tubing string capable of extending from the at least one landing tool;

observing the effects of the engagement of at least one landing tool with the at least one profile;

determining the amount of tubular string movement required to obtain a desired component placement within the wellbore, the desired component placement comprising the landing of a tubing hanger within a wellhead;

extending at least one lower tubing string from the landing tool into at least one lateral wellbore.

* * * * *